US005433159A

United States Patent [19]

Muramatsu

[11] Patent Number: 5,433,159

[45] Date of Patent: Jul. 18, 1995

[54] HORIZONTAL ROTATING HOOK FOR SEWING MACHINE

[75] Inventor: Naoki Muramatsu, Aichi, Japan

[73] Assignee: Mitsubishi Denki Kabushiki Kaisha, Tokyo, Japan

[21] Appl. No.: 102,276

[22] Filed: Aug. 5, 1993

[30] Foreign Application Priority Data

Aug. 5, 1992 [JP] Japan ..... 4-209091

[51] Int. Cl.[6] ..... D05B 57/14

[52] U.S. Cl. ..... 112/184; 112/231

[58] Field of Search ..... 112/181, 184, 231, 228, 112/229

[56] References Cited

FOREIGN PATENT DOCUMENTS 6437995 2/1989 Japan ..... 112/184
6464687 3/1989 Japan ..... 112/184
1145382 10/1989 Japan .

OTHER PUBLICATIONS

Mitsubishi Industrial Sewing Machine Instruction Manual for Model LT2-230.250 for Double-Need Lockstitch Automatic Undertrimmer, Variable Speed, T016A, Mitsubishi Electric, pub. Feb. 1983.

Mitsubishi Industrial Sewing Machine Instruction Manual for Model LU2-4410.4430 for Single-Needle, Double-Need Lockstitch Compound-Feed Automatic Undertrimmer Variable Speed Control, Mitsubishi Electric, pub. Jan. 1984.

*Primary Examiner*—Clifford D. Crowder
*Assistant Examiner*—Paul C. Lewis
*Attorney, Agent, or Firm*—Sughrue, Mion, Zinn, Macpeak & Seas; Richard C. Turner; Patrick J. Finnan

[57] ABSTRACT

A horizontal rotating hook for a sewing machine which has a structure so that an opener mechanism, which is adapted to wear and provide noise, is not required. The opener structure is avoided by using a needle thread fastener that is located adjacent to a rotating hook bobbin case holder position bracket in a rotating hook bobbin case holder for fastening needle thread temporarily. Thus, when the loop of the needle thread captured by the hook point of a rotating hook goes through into the rotating hook bobbin case holder, the rotating hook bobbin case holder is moved in a direction opposite to the rotation direction of the rotating hook (reversed) by the tension of the thread.

11 Claims, 8 Drawing Sheets

HORIZONTAL ROTATING HOOK FOR SEWING MACHINE

BACKGROUND OF THE INVENTION

1. Field of the Invention

The present invention relates to a horizontal rotating hook, having a rotating hook bobbin case holder, for use in a sewing machine. Most horizontal rotating hooks require an opener mechanism that oscillates back and forth to open a path for a needle thread used to form a stitch. In particular, the invention relates to a horizontal rotating hook which does not require an opener that moves the rotating hook bobbin case holder in a direction opposite to the rotation direction of a rotating hook when the loop of a needle thread goes into the rotating hook bobbin case holder.

2. Description of the Background Art

FIGS. 8 to 11 illustrate a conventional horizontal rotating hook device that may be used in a sewing machine. FIG. 8 is a perspective view of the horizontal rotating hook device, FIGS. 9(*a*) and 9(*b*) comprise an exploded perspective view showing the horizontal rotating hook device, FIG. 10 is a perspective view showing a throat plate, and FIG. 11 is a top view showing how the horizontal rotating hooks are installed on a twin-needle sewing machine. While there are two types of horizontal rotating hooks for the sewing machine, i.e., a single-piece type integral with a bobbin case and a separate type independent of the bobbin case wherein the bobbin case can be removed from a rotating hook bobbin case holder, the following description deals with the horizontal rotating hook including the single-piece type rotating hook bobbin case holder.

As shown in FIGS. 8, 9(*a*) and 9(*b*), the horizontal rotating hook comprises a rotating hook bobbin case holder 1 and a rotating hook 2. Referring to the drawings, the rotating hook bobbin case holder 1 is provided with a rotating hook bobbin case holder position bracket 3, an opener contact 4, a bobbin thread pull-off aperture 5, a bobbin support 6 and a race 7. The rotating hook bobbin case holder position bracket 3 is a projection provided in an external horizontal direction, starting at the cylinder top edge of the rotating hook bobbin case holder 1, to prevent the rotating hook bobbin case holder 1 from rotating. Bracket 3 is fitted into a gap 9 in a throat plate 8 shown in FIG. 10. The gap is formed as a space between two stoppers 9*a* and 9*b* provided on the bottom of the throat plate 8, and the width of the gap 9 is larger than the width of the rotating hook bobbin case holder position bracket 3.

The opener contact 4 is a cam colliding with an opener which will be described later. The bobbin thread pull-off aperture 5 is a slit from where the bobbin thread wound around a bobbin 10 (FIG. 11) fitted in the rotating hook bobbin case holder 1 is pulled off to the outside. The aperture 5 is provided in an L shape in the rotating hook bobbin case holder 1. On the external side face of the rotating hook bobbin case holder 1 in this area, a tension spring 11 is secured by screws 12, 13 in such a manner as to cover the bobbin thread pull-off aperture 5. The tension spring 11 shown has a bifurcated or forked front end. Due to the bifurcated shape, the front end fits in a hole 16 provided in the external side face of the rotating hook bobbin case holder 1. The bobbin thread pulled off to the outer periphery of the rotating hook bobbin case holder 1 via the bobbin thread pull-off aperture 5 is lead from the front end portion to a needle hole (which will be described later) along the outer periphery of the rotating hook bobbin case holder 1 and the inside of the tension spring 11. Spring force produced by the tension spring 11 works on the bobbin thread as tension. This tension is adjusted to predetermined tension by tightening and/or loosing the screw 13.

The bobbin support 6, which is a support shaft for loading the bobbin into the rotating hook bobbin case holder 1, is integrated with the rotating hook bobbin case holder 1 at the center of the inner bottom surface of the rotating hook bobbin case holder 1. A bobbin winder stop latch 14, which is provided at the top end portion of the bobbin support 6, is a latch used to prevent the bobbin 10 loaded in the rotating hook bobbin case holder 1 from disengaging. The bobbin stop latch 14 may be moved to work (or set) from a vertical position shown in FIG. 8 to a horizontal position shown in FIG. 9(*a*)–9(*b*) by a spring (not shown) in the bobbin support 6. A bobbin winder stop latch groove 15, in which the front end portion of the bobbin winder stop latch 14 fits, is provided at the top edge of the rotating hook bobbin case holder 1. When the bobbin winder stop latch 14 is set into this groove 15, the top height of the bobbin winder stop latch 14 is almost equal to the height of the rotating hook bobbin case holder 1. The race 7 is a projection having a slit provided in the external side face circumference of the rotating hook bobbin case holder 1, and its action will be described later.

The rotating hook 2 is provided with a hook point 20, a race groove 21 and a rotating hook shaft 22. The hook point 20 is a thread loop capturing catch which captures a loop formed by the needle thread and goes along the outer periphery of the rotating hook bobbin case holder 1. Stitches are formed by means of the needle and bobbin threads. The race groove 21 is a groove where the race 7 of the rotating hook bobbin case holder 1 fits and which comprises the rotating hook 2 above which top surface a rotating hook section 23 is fixed by screws 23*a*, 23*b*. A back plate 24 is secured to the external bottom surface of the rotating hook 2 by screws 24*a*, 24*b*.

The rotating hook shaft 22 functions to transmit rotation from a lower shaft (not shown) of the sewing machine to the rotating hook and simultaneously actuate the opener which will be described later. For this purpose, an eccentric shaft 25 is formed integrally at the top of the rotating hook shaft 22. A through hole 26 is provided in the rotating hook shaft 22 to supply lubricant to the race portion via an oil string fitted therein.

The horizontal rotating hook device consists of the horizontal rotating hook and an opener mechanism. As shown in FIGS. 9(*a*)–9(*b*) and 11, the opener mechanism comprises an opener 30, an opener support 31 and a connecting arm 32. The connecting arm 32 is an arm for jointly operating the eccentric shaft 25 of the rotating hook shaft 22 and the opener support 31. The arm 32 has two rings, one of the two rings is fitted with the eccentric shaft 25 and the other is secured rotatably to the opener support 31 by a stepped screw 33 and a nut 34. The opener 30 is installed on the arm portion of the opener support 31 by a screw 35, and an opener support shaft 36 is fitted into a ring which serves as the supporting point of the opener support 31. This shaft 36 is screwed to a hook saddle (not shown) secured on a sewing machine bed.

The horizontal rotating hook device arranged as described above is installed onto the sewing machine bed (not shown) as shown in FIG. 11. As seen from FIG. 11, the opener 30 collides with the opener contact 4 of the rotating hook bobbin case holder 1 in a positional relationship as shown. A feed dog 40 is located in the slot of the throat plate 8. This feed dog 40, which is fixed to a feed bar (not shown) of a sewing machine feed mechanism, makes an elliptical feed motion in synchronization with a needle motion. When this motion works on a fabric inserted between a presser mechanism and the feed dog, the fabric is fed. A needle hole 41 is provided in the center of the feed dog 40.

The operation of the horizontal rotating hook and opener mechanism will now be described. Referring to FIG. 11, when the sewing machine is rotatively driven, the rotating hook 2 fully rotates in the direction of arrow A (clockwise) and the opener 30 oscillates back and forth in the directions of arrows B and C at an angle determined by pitch lengths between the screws 33, 35 and opener support shaft 36 and by the eccentricity of the eccentric shaft 25, with the opener support shaft 36 acting as a supporting point. This oscillatory motion of the opener 30 allows the needle thread coming from the needle to easily pass the rotating hook bobbin case holder position bracket 3 and fully go along the outer periphery of the rotating hook bobbin case holder 1.

How the needle thread goes along the rotating hook bobbin case holder will now be described in detail with reference to FIGS. 12 to 14. FIG. 12 is a top view which illustrates how the needle thread is pulled off by the horizontal rotating hook device, FIG. 13 is a similar top view for the bobbin thread, and FIG. 14 is a sectional view taken along the plane E—E of FIG. 12. In FIG. 12, the numeral 50 indicates the needle thread. How it goes along the outer periphery of the rotating hook bobbin case holder 1 also is illustrated. Namely, as the hook point 20 (FIG. 9(*a*) of the rotating hook 2 having captured the loop of the needle thread turns in the direction of arrow A, the loop of the needle thread 50 advancing along the outer periphery of the rotating hook bobbin case holder 1 moves sequentially from position 50*a* to position 50*b*. Position 50*a* indicates an instant when the needle thread 50 passing through the needle hole 41 has disengaged from the stopper 9*a* of the throat plate 8 and is just entering the gap 9. At this point, the opener 30 is displaced at its maximum in the direction of C. Hence, the rotating hook bobbin case holder position bracket 3 of the rotating hook bobbin case holder 1 is forced to move to position 3a indicated by a broken line, where space S1 is formed between the rotating hook bobbin case holder position bracket 3 and the stopper 9*a*. For convenience of explanation, this space S1 is herein referred to as a first space.

In the meantime, the rotating hook bobbin case holder 1 is generally given rotating force in the direction of arrow A by frictional torque between itself and the rotating hook 2. For this reason, the rotating hook bobbin case holder position bracket 3 is pressed against the stopper 9*a*. In addition to this pressure force, the pull-off tension of the bobbin thread is further applied. In FIG. 13, which shows the path of the bobbin thread 51 pulled off from the bobbin 10, the position of the bobbin thread pull-off aperture 5 is within the range of two right angles in the counterclockwise rotating direction of the rotating hook 2 with respect to a segment connecting the center of the bobbin support 6 and the rotating hook bobbin case holder position bracket 3. Hence, the pull-off tension of the bobbin thread 51 works in a direction in which the rotating hook bobbin case holder 1 is rotated in the direction of arrow A. Generally, the set tension of 0.3 to 1N is applied beforehand to the bobbin thread 51 by the tension spring 11. This tension increases if the bobbin thread is pulled off at high speed.

Accordingly, the opener 30 rotates and displaces the rotating hook bobbin case holder 1 in a direction opposite to arrow A against the pressure force based on fractional torque and the pull-off tension of the bobbin thread. Consequently, as shown in FIG. 14, the needle thread 50 on the needle side shifts from continuous-line position 50*c* to broken-line position 50*d*. Namely, the needle thread passes the first space.

Thereafter, when the needle thread 50 reaches position 50*b* in FIG. 12 in the progress of rotation, the opener 30 is displaced at its maximum in the direction of arrow B. Along with this, space S2 is produced between the rotating hook bobbin case holder position bracket 3 and the stopper 9*b* of the throat plate 8, whereby the loop of the needle thread 50 passes the rotating hook bobbin case holder section easily. For convenience of explanation, this space S2 is referred to as a second space. When the needle thread 50 finishes rotating along the rotating hook bobbin case holder 1, the needle thread 50 is tangled with the bobbin thread, forming a stitch.

In the conventional horizontal rotating hook for use in the sewing machine arranged as described above, the opener mechanism was indispensable for the loop of the needle thread to go through into the rotating hook bobbin case holder and form stitches along with the bobbin thread. However, the opener impinged on the opener contact of the rotating hook bobbin case holder and further the rotating hook bobbin case holder position bracket impinged on the stopper of the throat plate, generating significant noise. When the sewing machine was driven at high speed, e.g. 4000 r/min., the noise level sometimes exceeded 90 dB(A), hindering stitching worker operability considerably. Also, the impingement of the rotating hook bobbin case holder position bracket on the stopper of the throat plate caused the rotating hook bobbin case holder position bracket to result in fatigue failure.

SUMMARY OF THE INVENTION

It is, accordingly, an object of the present invention to overcome the disadvantages in the conventional design by providing a horizontal rotating hook for a sewing machine which has a new structure so that an opener mechanism is not required.

The first and second embodiments achieve a horizontal rotating hook which does not require an opener mechanism, is simple in structure, and reduces impact noise.

The first embodiment includes needle thread fastening means adjacent to a rotating hook bobbin case holder position bracket in a rotating hook bobbin case holder for fastening a needle thread temporarily so that when the loop of the needle thread captured by the hook point of a rotating hook goes through into the rotating hook bobbin case holder, the rotating hook bobbin case holder is oscillated in a direction opposite to the rotation direction of the rotating hook (reversed) by the tension of the thread.

The second embodiment includes needle thread fastening means adjacent to a rotating hook bobbin case holder position bracket in the cylinder top surface of a removable bobbin case provided in a rotating hook bobbin case holder.

The third embodiment will achieve a horizontal rotating hook which further reduces impact noise in addition to the effects produced by the first and second embodiments. In the third embodiment, a bobbin thread pull-off aperture in a rotating hook bobbin case holder is provided on its outer periphery within the range of two right angles in the rotation direction of a rotating hook with respect of a segment connecting the center of a bobbin support for a bobbin thread and a rotating hook bobbin case holder position bracket so that the rotating hook bobbin case holder is provided with torque in a direction opposite to the rotation direction of the rotating hook by the tension of said bobbin thread pulled off.

BRIEF DESCRIPTION OF THE DRAWINGS

FIG. 3(*a*) shows the bobbin case and FIG. 3(*b*) shows the rotating hook bobbin case holder.

FIG. 4(*a*) shows a single-piece rotating hook bobbin case holder integral with a bobbin case and FIG. 4(*b*) shows a separate type rotating hook bobbin case holder independent of a bobbin case.

FIG. 6(*a*) shows the bobbin case and FIG. 6(*b*) shows the rotating hook bobbin case holder.

DESCRIPTION OF THE PREFERRED EMBODIMENTS

Figure 1:
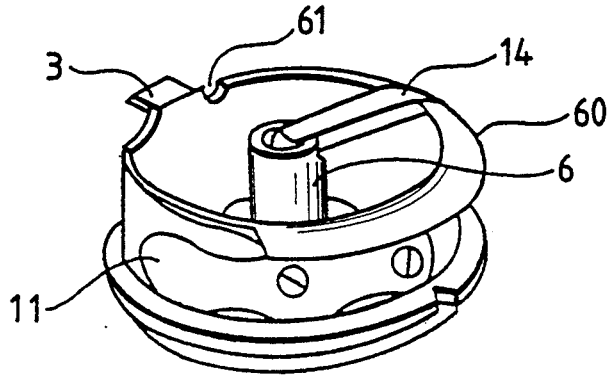
FIG. 1 is a perspective view of a one-piece rotating hook bobbin case holder integral with a bobbin case in a horizontal rotating hook for a sewing machine according to a preferred embodiment with the first invention.

A preferred embodiment of the first invention will now be described with reference to FIGS. 1 and 2, wherein reference characters identical to those in the conventional design designate identical or corresponding parts.

FIG. 1 is a perspective view of a single-piece rotating hook bobbin case holder integral with a bobbin case in a horizontal rotating hook of a sewing machine. FIG. 2 is a top view of the horizontal rotating hook employed to describe how a needle thread moves. In FIG. 1, the numeral 60 indicates a rotating hook bobbin case holder and 61 denotes a notch-like needle thread contact (recess) serving as needle thread fastening means formed adjacent to a rotating hook bobbin case position bracket 3 in the cylinder top edge of the rotating hook bobbin case holder 60. In FIG. 2, 50 and 50*e* to 50*g* indicate the needle thread.

The notch-like needle thread contact (recess) 61, which is formed adjacent to the rotating hook bobbin case holder position bracket 3 in the rotating hook bobbin case holder 60, is located on the side of the position bracket 3 which is in the direction of rotation of the rotating hook 2 (not shown). When the loop of the needle thread captured by a hook point (not shown) of the rotating hook goes into the rotating hook bobbin case holder 60, the needle thread contact (recess) 61 temporarily fastens the needle thread 50 to oscillate the rotating hook bobbin case holder 60 in a direction opposite to the rotating direction of the rotating hook by the tension of said needle thread 50. The needle thread contact (recess) 61 is finished to a smooth surface. A bobbin winder stop latch 14 is formed so that it is directed to be substantially parallel with the major axis of a throat plate 8 when the horizontal rotating hook is assembled in the sewing machine.

Operation will now be described. Referring to FIG. 2, when the sewing machine is rotatively driven, the rotating hook 2 is rotated in the direction of arrow A. Along with this, the rotating hook bobbin case holder 60 is also rotated in the same direction by frictional torque. Hence, the rotating hook bobbin case holder position bracket 3 is generally pressed against a stopper 9*a* of the throat plate 8 as in the conventional design. Meanwhile, as the rotating hook 2 rotates, the loop of the needle thread 50 captured by the hook point 20 of the rotating hook 2 moves sequentially from positions 50 to 50*e* to 50*f* to 50*g*.

Figure 14:
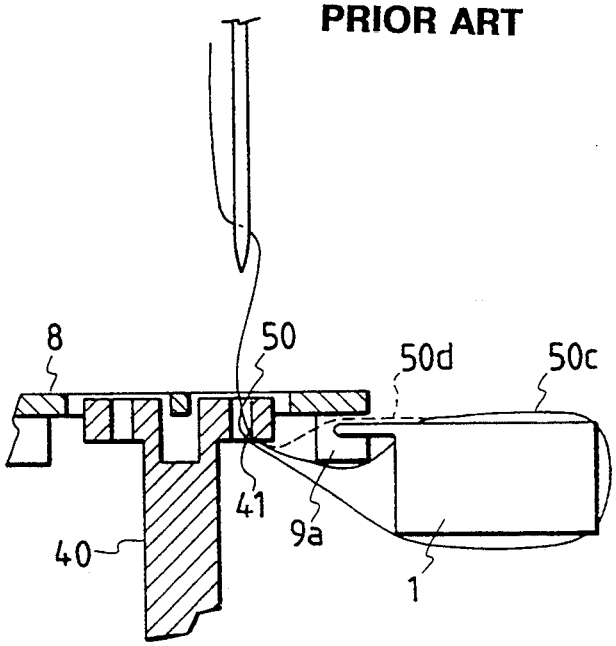
FIG. 14 PRIOR ART
FIG. 14 is a sectional view taken along the plate E—E of FIG. 12.

On reaching position 50*f*, the needle thread 50 makes contact with the needle thread contact 61 (drops into and caught by the recess) and generates pressure force for an extremely short time. This pressure force is much larger than frictional force produced on the top edge of the rotating hook bobbin case holder 60 on the extension line of the needle thread or the tension of the bobbin thread. Hence, the rotating hook bobbin case holder 60 is instantaneously given torque in an opposite rotating direction and is rotated and displaced in the direction of arrow B. Along with this, a first space S1 is produced between the stopper 9*a* and bracket 3. As a result, the needle thread 50 passes the first space S1 easily and moves toward the top of the rotating hook bobbin case holder 60 indicated by 50*d* (shown in FIG. 14).

Once the needle thread 50 has passed the first space S1, the pressure force which provides the rotating hook bobbin case holder 60 with torque in the opposite rotating direction is released. Consequently, the rotating hook bobbin case holder 60 is rotated again in the direction of arrow A by the frictional force with the rotating hook 2 or the pull-off tension of the bobbin thread. A second space S2 is then formed between the stopper 9*b* and bracket 3 section. The needle thread moves from positions 50*f* to 50*g*, . . . passes this second space S2 easily as it is pulled up by a thread take-up lever. When the needle thread 50 rotates one turn around the rotating hook bobbin case holder 60, i.e. around the bobbin thread, one stitch is formed.

Figure 3A:
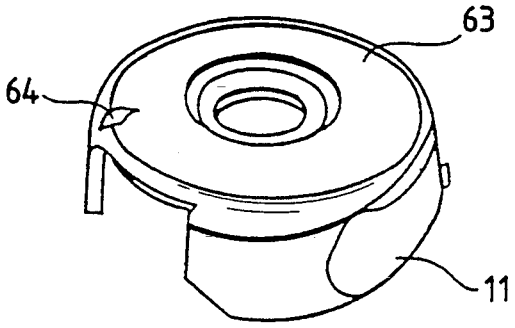
FIG. 3(*a*)–3(*b*) are a perspective view of a separate type rotating hook bobbin case holder independent of a bobbin case in a horizontal rotating hook for a sewing machine according to a preferred embodiment with the second invention.
Figure 3B:
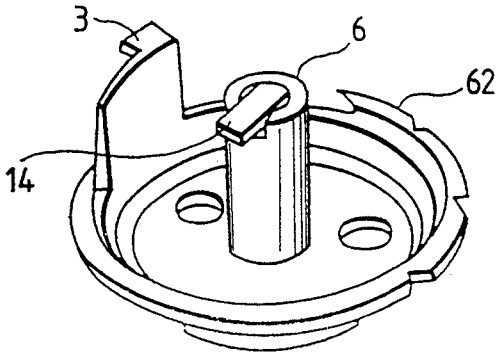

A preferred embodiment of the second invention will now be described with reference to FIGS. 3(*a*) and 3(*b*), which are perspective views of a separate type rotating hook bobbin case holder and a bobbin case in a horizontal rotating hook for the sewing machine. FIG. 3(*a*) shows the bobbin case and FIG. 3(*b*) shows the rotating hook bobbin case holder. In FIGS. 3(*a*) and 3(*b*), 62 indicates a separate type rotating hook bobbin case holder, 63 indicates a bobbin case, and 64 shows a notch-like needle thread contact (recess) acting as needle thread fastening means formed in the bobbin case 63. It is formed adjacent to the rotating hook bobbin case holder position bracket 3 in the cylinder top surface of the bobbin case 63 when the bobbin case 63 is set into the rotating hook bobbin case holder 62. In the separate type rotating bobbin case holder, the bobbin case 63 is designed to be removable from the rotating hook bobbin case holder 62.

Like the rotating hook bobbin case 60 shown in the first embodiment, the rotating hook bobbin case holder 62 of the horizontal rotating hook shown in the second embodiment does not include the opener contact 4 which is used in the conventional design. Instead, the cylinder top surface of the bobbin case 63 is provided with the small notch-like needle thread contact (recess) 64 on an upstream rotation side adjacent to the rotating hook bobbin case holder position bracket 3, i.e. at the position of the bobbin case 63 on the upstream rotation side adjacent to the rotating hook bobbin case holder position bracket 3 when the bobbin case 63 is fitted to the rotating hook bobbin case holder 62. In addition, the needle thread contact (recess) 64 of the bobbin case 63 is finished to a smooth surface. Further, also in case of the rotating hook bobbin case holder 62, the bobbin winder stop latch 14 is formed so that it is directed to be substantially parallel with the major axis of the throat plate 8 when the horizontal rotating hook is assembled in the sewing machine.

Figure 2:
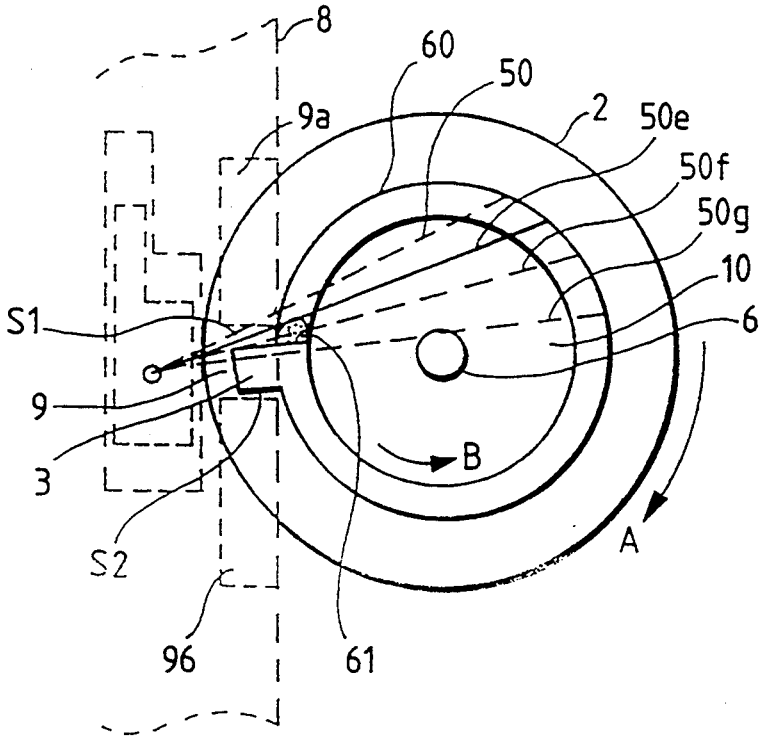
FIG. 2 is a top view of the horizontal rotating hook shown in FIG. 1 and illustrates how a needle thread moves.

The operation of embodiment 2 is identical to that of embodiment 1 shown in FIG. 2. Namely, as the rotating hook 2 rotates, the loop of the needle thread 50 captured by the hook point 20 of the rotating hook 2 moves sequentially from one position to another. On reaching position 50*e*, the needle thread 50 makes contact with the needle thread contact 64 (drops into and is caught by the recess) and produces pressure force for an extremely short length of time. This causes the rotating hook bobbin case holder 62 to be instantaneously provided with torque in the opposite rotating direction. This torque causes the first space S1 to be produced between the stopper 9*a* and the bracket 3, allowing the needle thread 50 to pass the first space S1 easily. Once the needle thread 50 has passed the first space S1, the pressure force giving the rotating hook bobbin case holder 60 torque in the opposite rotation direction is released, the needle thread passes the second space S2 as it is pulled up by the thread take-up lever, and one stitch is formed.

Figure 4A:
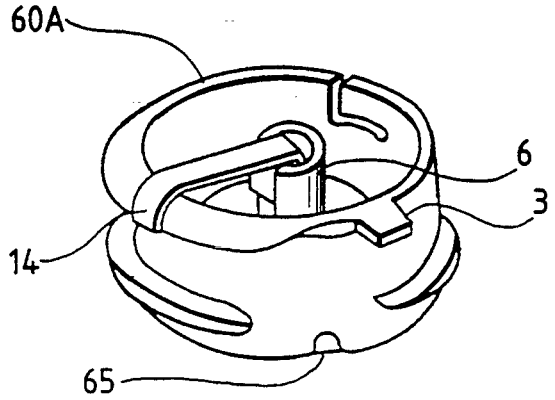
FIG. 4(*a*)–4(*b*) are a perspective view of rotating hook bobbin case holders in a horizontal rotating hook for a sewing machine according to another preferred embodiment with the first and second inventions.
Figure 4B:
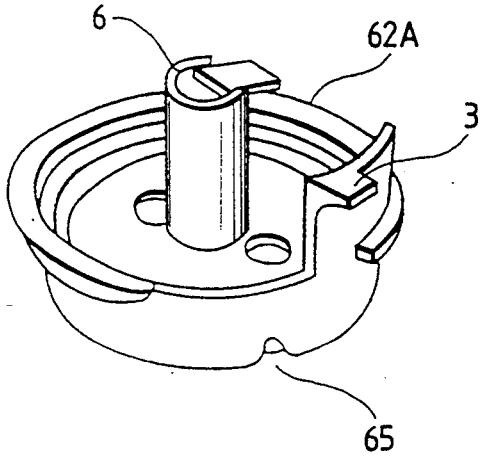

Another preferred embodiment with the first and second inventions will now be described with reference to FIGS. 4(*a*) and 4(*b*), which are perspective views of rotating hook bobbin case holders in the horizontal rotating hook for the sewing machine. FIG. 4(*a*) is a perspective view of a unitary rotating hook bobbin case holder integral with a bobbin case, and FIG. 4(*b*) is a perspective view of a separate type rotating hook bobbin case holder independent of a bobbin case. In FIGS. 4(*a*) and 4(*b*), 65 indicates notch-like needle thread contacts (recess) serving as needle thread fastening means formed in the bottom edge of rotating hook bobbin case holders 60A and 62A respectively, and formed adjacent to the rotating hook bobbin case holder position bracket 3. Namely, the notch-like needle thread contact is away from the rotating hook bobbin case holder position bracket 3 by a predetermined distance equivalent to the thickness of the rotating hook bobbin case holder in a rotating axis direction, but when viewed in the axial direction, a central angle made by their locations about the rotating axis is small and they are adjacent to each other.

Like the rotating hook bobbin case holders shown in embodiments 1 and 2, the rotating hook bobbin case holders 60A, 62A of the horizontal rotating hook shown in the third embodiment do not include the opener contact 4. Instead, the cylinder top surface of the bobbin case 64 is provided with a small notch-like needle thread contact (recess) 65 on the upstream rotation side of the bottom side edge adjacent to the rotating hook bobbin case holder position bracket 3.

The operation of the third embodiment is identical to that of embodiment 1 shown in FIG. 2. That is, as the rotating hook 2 rotates, the loop of the needle thread 50 captured by the hook point 20 of the rotating hook 2 moves sequentially from one position to another, and on reaching position 50*e*, the needle thread 50 makes contact with the needle thread contact 65 (drop into and caught by the recess) and produces pressure force for an extremely short period of time. This causes the rotating hook bobbin case holder 60A or 62A to be instantaneously given torque in the opposite rotating direction and the first space S1 to be produced between stopper 9(*a*) and the bracket 3 allowing the needle thread 50 to pass the first space S1 easily. Once the needle thread 50 has passed the first space S1, the pressure force providing the rotating hook bobbin case holder 60A or 62A torque in the opposite rotation direction is released, the needle thread passes the second space S2 as it is pulled up by the thread take-up lever, and one stitch is formed.

Figure 5:
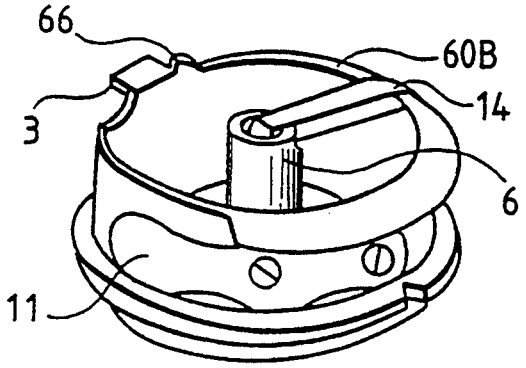
FIG. 5 is a perspective view of a single-piece rotating hook bobbin case holder integral with a bobbin case in a horizontal rotating hook for a sewing machine according to another preferred embodiment with the first invention.
Figure 6A:
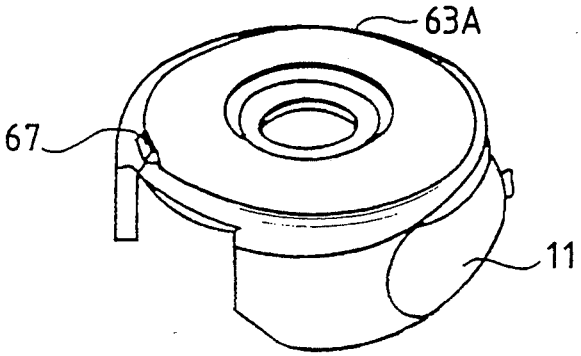
FIG. 6(*a*)–6(*b*) are a perspective view of a separate type rotating hook bobbin case holder independent of a bobbin case in a horizontal rotating hook for a sewing machine according to another preferred embodiment with the second invention.
Figure 6B:
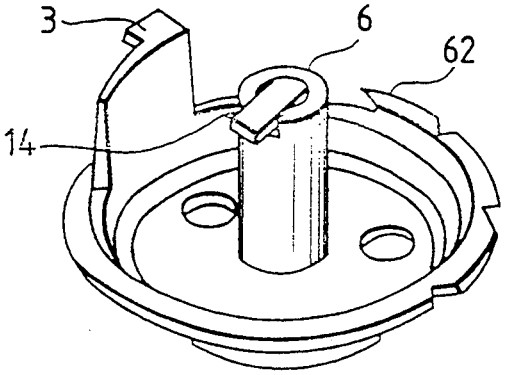

Another embodiment of the invention will now be described with reference to FIGS. 5, 6(*a*) and 6(*b*), which are perspective views of rotating hook bobbin case holders in the horizontal rotating hook for the sewing machine. FIG. 5 is a perspective view of a single-piece rotating hook bobbin case holder integral with a bobbin case. FIG. 6(*a*) shows a bobbin case of a separate type rotating hook bobbin case holder independent of a bobbin case, and FIG. 6(*b*) shows a rotating hook bobbin case holder. In FIG. 5, 66 indicates a projection-like needle thread contact acting as needle thread fastening means formed on the cylinder top edge of a rotating hook bobbin case holder 60B, and more specifically, formed adjacent to the rotating hook bobbin case holder position bracket 3. In FIG. 6(*a*), 67 indicates a projection-like needle thread contact acting as needle thread fastening means formed on the cylinder top surface of a bobbin case 63A of a rotating hook bobbin case holder 62, and more specifically, formed adjacent to the rotating hook bobbin case holder position bracket 3.

Like the rotating hook bobbin case holders shown in embodiments 1 and 2, the rotating hook bobbin case holders 60B, 62 of the horizontal rotating hook shown in embodiment 4 do not include the opener contact 4. Instead, the cylinder top edge of the rotating hook bobbin case holder 60B and the cylinder top surface of the bobbin case 63A are provided with a small projection-like needle thread contacts 66 and 67, respectively, on an upstream rotation side adjacent to the rotating hook bobbin case holder position bracket 3. In addition, the projection-like needle thread contacts 66, 67 are finished to a smooth surface.

The projection-like needle thread contacts 66 and 67, which are formed adjacent to the rotating hook bobbin case holder position bracket 3 in the rotating hook bobbin case holder 60B and bobbin case 63A, respectively, are located on the rotation direction side of free-running with the rotating hook 2 (not shown). When the loop of the needle thread captured by the hook point (not shown) of the rotating hook goes through into the rotating hook bobbin case holder 60B or 62, the needle thread contact 66 or 67 temporarily fastens the needle thread to oscillate the rotating hook bobbin case holder in a direction opposite to the rotation direction of the rotating hook 2 by the tension of the needle thread.

The operation of the fourth embodiment is identical to that of the first embodiment shown in FIG. 2. That is, as the rotating hook rotates, the loop of the needle thread 50 captured by the hook point 20 of the rotating hook moves sequentially from one position to another, and when reaching position 50*e*, the needle thread 50 makes contact with the needle thread contact 66 or 67 (caught by the projection) and generates pressure force for an extremely short time. This causes the rotating hook bobbin case holder 60B or 62 to be instantaneously provided with torque in the opposite rotation direction and the first space S1 to be produced between the stopper 9*a* and bracket 3, allowing the needle thread 50 to pass the first space S1 easily. Once the needle thread 50 has passed the first space S1, the pressure force providing the rotating hook bobbin case holder 60B or 62 torque in the opposite rotation direction is released, the needle thread passes the second space S2 at it is pulled up by the thread take-up lever, and one stitch is formed.

Figure 7:
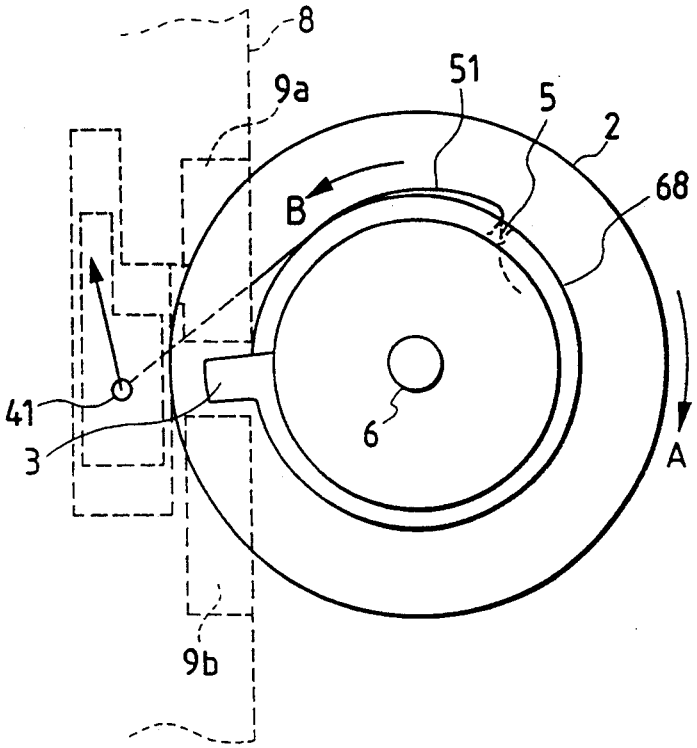
FIG. 7 is a top view of a horizontal rotating hook for a sewing machine according to a preferred embodiment with the third invention an illustrates how a bobbin thread is pulled off.
Figure 8:
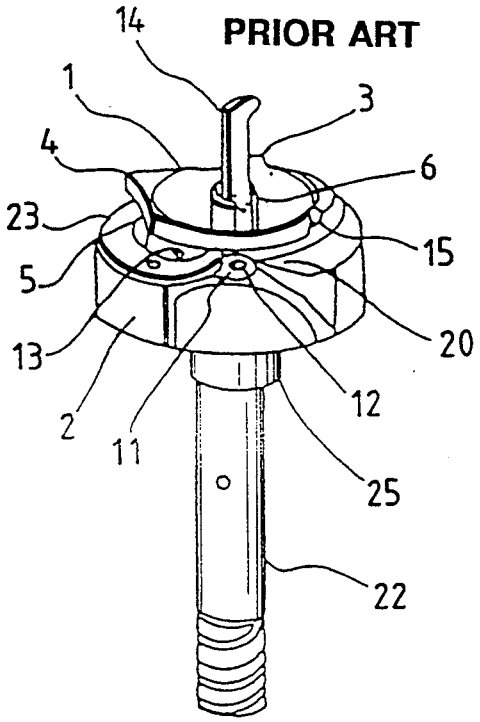
FIG. 8 is a perspective view of a horizontal rotating hook for a sewing machine known in the art, which shows a single-piece rotating hook bobbin case holder integral with a bobbin case.
Figure 9A:
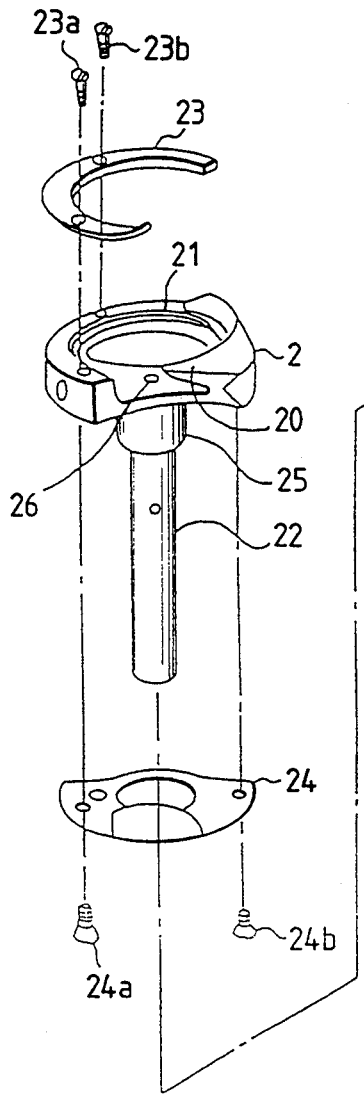
FIG. 9(a) PRIOR ART
FIG. 9(*a*)–9(*b*) are an exploded perspective view illustrating a horizontal rotating hook device including the horizontal rotating hook shown in FIG. 8.
Figure 9B:
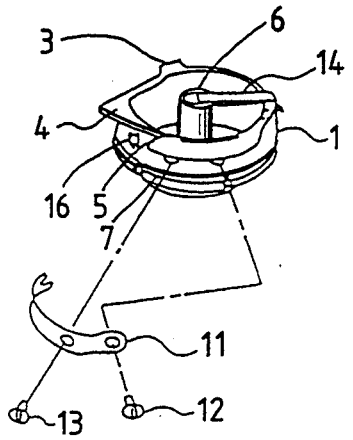
FIG. 9(b) PRIOR ART
Figure 9B:
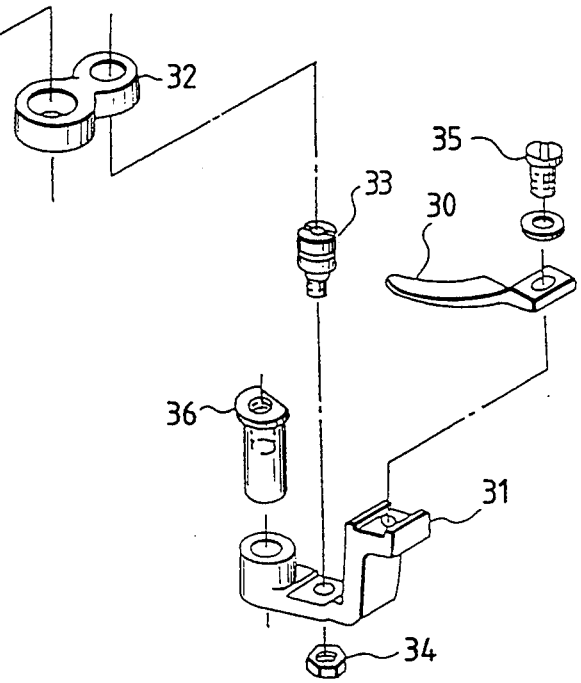
FIG. 9(b) PRIOR ART
Figure 10:
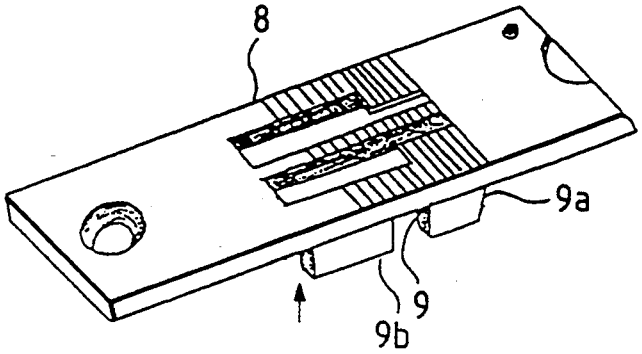
FIG. 10 PRIOR ART
FIG. 10 is a perspective view illustrating a throat plate found in the conventional design and the preferred embodiments with the first to third inventions.
Figure 11:
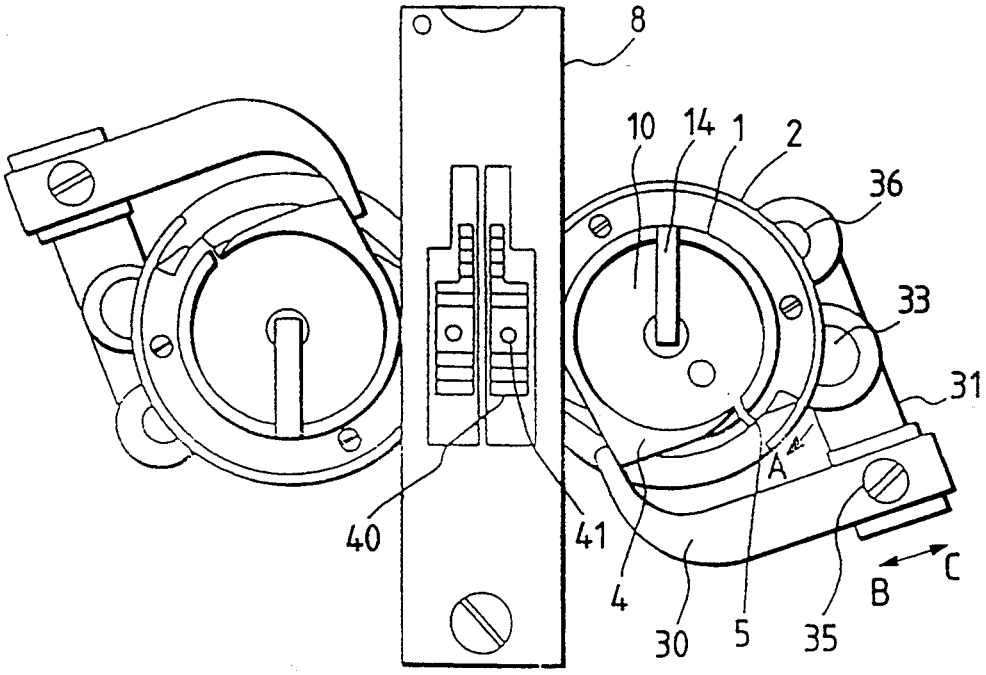
FIG. 11 PRIOR ART
FIG. 11 is a top view showing how a horizontal rotating hook is installed in a twin-needle sewing machine known in the art.
Figure 12:
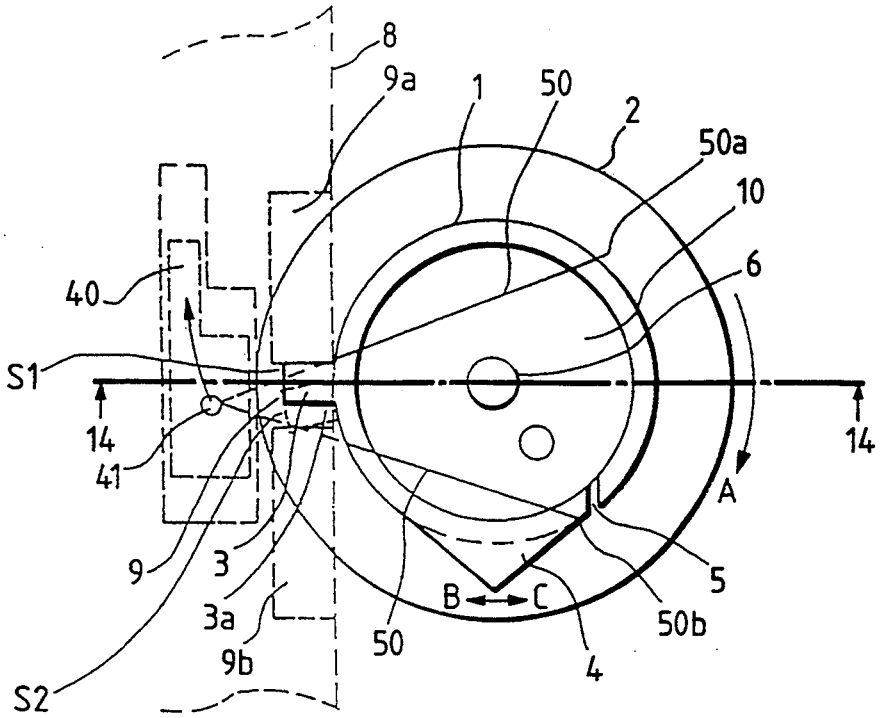
FIG. 12 PRIOR ART
FIG. 12 is a top view of the horizontal rotating hook shown in FIG. 8 and illustrates how a bobbin thread is pulled off.
Figure 13:
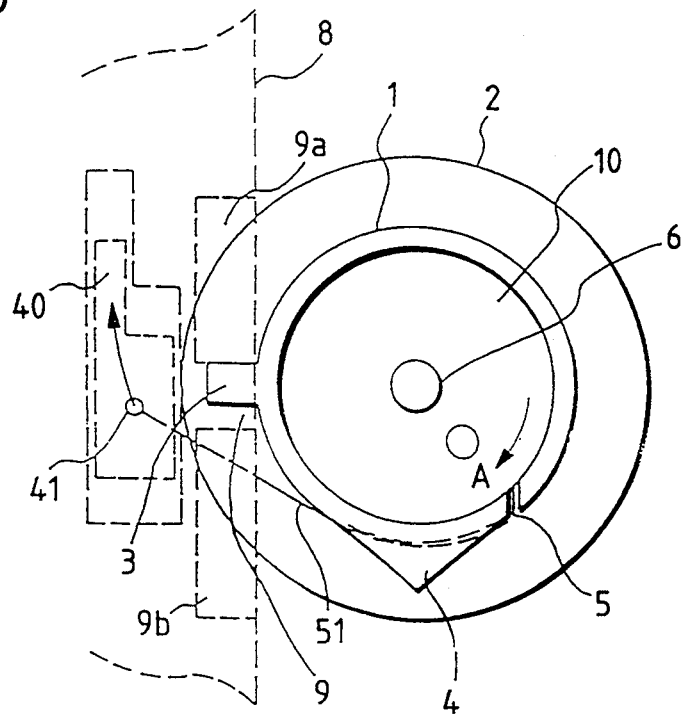
FIG. 13 PRIOR ART
FIG. 13 is a top view of the horizontal rotating hook shown in FIG. 8 and illustrates how the bobbin thread is pulled off.

Another preferred embodiment with the fifth invention will now be described with reference to FIG. 7, which is a top view of a horizontal rotating hook. In this drawing, 68 indicates a rotating hook bobbin case holder which is provided with a bobbin thread pull-out aperture a slit 5 in the same position as the one shown in Japanese Patent Disclosure Publication No. 37995 of 1989 or in Japanese Patent Disclosure Publication No. 64687 of 1989.

In the rotating hook bobbin case holder 60 in embodiment 1, the bobbin thread pull-off aperture 5 of the horizontal rotating hook for use in the sewing machine in embodiment 5 is provided in the same position with the one shown in Japanese Patent Disclosure Publication No. 37995 of 1989 or in Japanese Patent Disclosure Publication No. 64687 of 1989. Namely, this horizontal rotating hook is characterized in that the bobbin thread pull-off aperture 5 is provided within the range of two right angles in the clockwise rotation direction of the rotating hook 2 with respect to a segment connecting the center of the bobbin support 6 and the rotating hook bobbin case holder position bracket 3. The other parts are identical to those of the rotating hook bobbin case holder 60 shown in the first embodiment.

The operation of the fifth embodiment is identical to that of embodiment 1 with the exception that the pull-off tension of the bobbin thread is added to the pressure force of the needle thread 50 as reverse-rotation torque to the rotating hook bobbin case holder 68. In the rotating hook bobbin case holder 60 shown in embodiment 1, the pull-off tension of the bobbin thread 51 works in the direction of forward rotation (direction of arrow A in FIG. 2), as in the conventional design. Hence, the tension is opposite of the pressure force of the needle thread 50 produced in the rotating hook bobbin case holder 60 in the direction of reverse rotation (direction of arrow B in FIG. 2).

By contrast, the bobbin thread pull-out aperture 5 shown in the fifth embodiment is provided on a more upstream side in the rotation direction than the rotating hook bobbin case holder position bracket 3. Hence, the pull-off tension of the bobbin thread also works in the direction of reverse rotation, which is advantageous to the formation of the first space. It should be noted that the pull-off tension of the bobbin thread is smaller than the pressure force produced when the needle thread goes along the outer periphery of the rotating hook bobbin case holder.

If the position of the bobbin thread pull-off aperture 5 is identical to that of the one shown in Japan Laid-Open Publication No. 37995 of 1989 or in Japan Laid-Open Publication No. 64687 of 1989 in the rotating hook bobbin case holder or bobbin case in embodiments 2 to 4, these embodiments have the same effect as in embodiment 5. That is, the same effect is produced by the bobbin case, as shown in Japan Laid-Open 64687 of 1989, by providing the bobbin thread pull-off aperture 5 within the range of two right angles in the clockwise rotation direction of the rotating hook 2 with respect to the segment connecting the center of the bobbin support 6 and the rotating hook bobbin case holder position bracket 3 when the bobbin case is fitted to the rotating hook bobbin case holder 62.

In the first through fifth embodiments, wherein the pressure force of the needle thread against the needle thread contact is utilized so that torque in the direction of reverse rotation works on the rotating hook bobbin case holder, the space S1 is always formed consistently without being affected by a stitching direction (forward or reverse), a single-stitch length, a thread used and a fabric to be stitched.

In addition, the opener mechanism, such as the opener 30, opener support 31, connecting arm 32 and opener support shaft 36 in the conventional design, is not required. As a result, the eccentric shaft 25 formed integrally with the rotating hook shaft 22 of the horizontal rotating hook in the conventional design is not required. In other words, the rotating hook shaft 22 for transmitting rotation from the lower shaft of the sewing machine can be built in uniform diameter.

Further, in the first to fifth embodiments, the needle thread contacts serving as the needle thread fastening means are not limited to the notch-like needle thread contact (recess) and the projection-like needle thread contact illustrated therein, and they produce the same effect if they have a difference in level formed to fasten the needle thread.

As described above, in any of the first through fifth embodiments, the tension of the needle thread is designed to work as pressure force which recesses the rotating hook bobbin case holder when the needle thread goes along the outer periphery of the rotating hook bobbin case holder, whereby the opener mechanism is not required, impact noise generated by the impingement of the opener on the opener contact and the resultant impact noise produced by the impingement of the rotating hook bobbin case holder position bracket on the stopper have been extinguished essentially. Also, the elimination of the eccentric portion from the rotating hook shaft has facilitated the manufacturing of the hook, and impact absorption upon the impingement on the throat plate stopper helps prevent the rotating hook bobbin case holder position bracket from resulting in fatigue failure. Further, since about 10 parts have been reduced, costs have decreased and complex assembly and adjustment works are not required.

What is claimed is:

1. A horizontal rotating hook for a sewing machine comprising:

a rotating hook having a hook point on its circumference for capturing a needle thread to form a stitch with said needle thread and being rotatively driven in a predetermined direction; and a rotating hook bobbin case holder having an outer periphery and an inner space for containing a bobbin which is wound with a bobbin thread, fitted relatively rotatably to said rotating hook, having on its outer periphery a bobbin thread pull-off aperture for pulling off said bobbin thread and a rotating hook bobbin case holder position bracket engaged movably at a predetermined angle between a pair of stoppers formed on a throat plate to prevent free-running with said rotating hook;

said rotating hook bobbin case holder having needle thread fastening means adjacent to said rotating hook bobbin case holder position bracket on a side which is in the rotation direction of said rotating hook: for temporarily fastening said needle thread in order to move said rotating hook bobbin case holder in a direction opposite to the rotation direction of said rotating hook by the tension of said needle thread when the loop of said needle thread captured by said hook point goes through into said rotating hook bobbin case holder.

2. The horizontal rotating hook for a sewing machine as defined in claim 1, wherein said rotating hook bobbin case holder comprises a removable bobbin case having a cylinder top surface and said needle thread fastening means is formed adjacent to said rotating hook bobbin case holder position bracket on said cylinder top surface of said bobbin case.

3. The horizontal rotating hook for a sewing machine as defined in claim 1, wherein said bobbin thread pull-off aperture is positioned on its outer periphery such that tension of said bobbin thread exerts a torque on said rotating hook bobbin case holder in a direction opposite to the rotating direction of said rotating hook.

4. The horizontal rotating hook for a sewing machine as defined in claim 2, wherein said bobbin thread pull-off aperture is positioned on its outer periphery such that tension of said bobbin thread exerts a torque on said rotating hook bobbin case holder in a direction opposite to the rotating direction of said rotating hook.

5. The horizontal rotating hook for a sewing machine as defined in claim 3, wherein said aperture is positioned within the range of two right angles in the rotation direction of the rotating hook with respect to a segment connecting the center of a bobbin support of the bobbin thread pulled off and the rotating hook bobbin case holder position bracket.

6. A horizontal rotating hook for a sewing machine comprising:

a rotating hook having a hook point on its circumference for capturing a needle thread to form a stitch with said needle thread and being rotatively driven in a predetermined direction;

a rotating hook bobbin case holder having an outer periphery and an inner space for containing a bobbin which is wound with a bobbin thread, fitted relatively rotatably to said rotating hook, and having on its outer periphery a bobbin thread pull-off aperture for pulling off said bobbin thread; and needle thread fastening means for temporarily fastening said needle thread in order to move said rotating hook bobbin case holder in a direction opposite to the rotation direction of said rotating hook by the tension of said needle thread when the loop of said needle thread captured by said hook point goes through into said rotating hook bobbin case holder.

7. The horizontal rotating hook as set forth in claim 6, wherein said needle thread fastening means comprises a projection to restrain said thread and create a reverse torque on said hook bobbin case holder.

8. The horizontal rotating hook as set forth in claim 6, wherein said needle thread fastening means comprises a recess to restrain said thread and create a reverse torque on said hook bobbin case holder.

9. The horizontal rotating hook as set forth in claim 6, wherein said sewing machine is a double needle machine having right and left hand needles as viewed by an operator and said hook is for said right needle.

10. A sewing machine stitching mechanism having at least one needle and a source of needle thread, a horizontal rotating hook and a bobbin within a bobbin case holder providing a source of bobbin thread, wherein the improvement comprises:

means for providing a tension on said needle thread for providing a reverse rotational torque on said bobbin case holder, said torque being sufficient to reverse a direction of rotation of said bobbin case holder.

11. A sewing machine stitching mechanism having at least one needle and a source of needle thread, a horizontal rotating hook and a bobbin within a bobbin case holder providing a source of bobbin thread, wherein the improvement comprises:

means for providing a tension on said needle thread for providing a reverse rotational torque on said bobbin case holder, wherein, said means for providing tension on said needle thread consists of needle thread fastening means for capturing and holding said needle thread, and wherein the sewing machine stitching mechanism further comprises bobbin thread tensioning means for applying a tension to said bobbin thread, said bobbin thread tensioning means and said needle thread fastening means being operative to provide tension on said bobbin thread and needle thread, respectively, whereby torque is generated on said bobbin case holder.

* * * * *